United States Patent [19]

Ide et al.

[11] Patent Number: 4,940,975

[45] Date of Patent: Jul. 10, 1990

[54] RADIO PAGER RECEIVER CAPABLE OF READILY CHECKING WHETHER OR NOT MEMORY BACKUP IS CORRECT

[75] Inventors: Motoki Ide; Toshifumi Sato, both of Tokyo, Japan

[73] Assignee: NEC Corporation, Tokyo, Japan

[21] Appl. No.: 161,815

[22] Filed: Feb. 29, 1988

[30] Foreign Application Priority Data

Feb. 27, 1987 [JP] Japan ..... 62-45741

[51] Int. Cl.[5] ..... G08B 5/22

[52] U.S. Cl. ..... 340/825.44; 340/311.1; 455/343

[58] Field of Search ..... 340/825.44–825.48, 340/311.1; 455/31, 38, 343, 186; 379/56, 57; 371/66, 22; 365/226, 228, 229; 364/187, 186

[56] References Cited

U.S. PATENT DOCUMENTS

| | | | |
|---|---|---|---|
| 4,079,453 | 3/1978 | Dahl | 371/21 |
| 4,355,390 | 10/1982 | Hellwig et al. | 371/21 |
| 4,369,443 | 1/1983 | Giallanza et al. | 340/825.44 |
| 4,646,307 | 2/1987 | Nishimura | 371/66 |
| 4,766,434 | 8/1988 | Matai et al. | 340/825.44 |
| 4,779,091 | 10/1988 | Oyagi et al. | 340/825.44 |

OTHER PUBLICATIONS

Desautels et al., "Battery Backup Failure Detection", IBM Technical Disclosure Bulletin, vol. 26, No. 6, Nov. 1983.

*Primary Examiner*—Donald J. Yusko
*Assistant Examiner*—Edwin C. Holloway, III
*Attorney, Agent, or Firm*—Sughrue, Mion, Zinn, Macpeak & Seas

[57] ABSTRACT

In a radio pager receiver comprising a memory (14) which is activated by main electric power and backed up by backup electric power, and which has a message area and an additional area for memorizing messages and administration data for administration of the messages, respectively, a message processor (20) is included in the receiver to judge whether or not the administration data are correctly kept in the additional area when the memory and the message processor are activated after the message processor is once deactivated. The message processor thereby produces a result signal representative of judgement. The message processor may process the message signals to have the administration data related to one another in accordance with a logical relationship. In this event, the message processor judges whether or not the logical relationship is correctly kept in the additional area. The logical relationship is checked by message linkage information indicative of a message order on processing the message signals. The logical relationship may also be checked by another linkage information related to a length of each message. The message processor may erase the messages and the administration data from the message area and the additional area when the result of judgement indicates that the administration data are not correctly kept in the additional area.

5 Claims, 6 Drawing Sheets

RADIO PAGER RECEIVER CAPABLE OF READILY CHECKING WHETHER OR NOT MEMORY BACKUP IS CORRECT

BACKGROUND OF THE INVENTION

This invention relates to a radio pager receiver that can receive message signals carrying messages and destined to the pager receiver.

A radio pager receiver becomes widespread which can provide not only an indication of a call received by the pager receiver but also visual displays of a message on a display unit, such as a liquid crystal display (LCD).

For this purpose, the pager receiver comprises a message processor activated by main electric power supplied from a main battery through a manually operable power source switch. The message processor is for processing the message signals into the respective messages and administration data for use in administrating the messages. In this event, the message processor processes the message signals to have the administration data related to one another in accordance with a logical relationship. More specifically, the message processor makes the logical relationship comprise message linkage information. For each of the messages, the message linkage information is indicative of a message order in which the message signals are processed into the respective messages.

A memory is coupled to the message processor and is activated by the main electric power. The memory has a message area for storing the messages and an additional area for storing the administration data. The messages are stored in the message area while the administration data are stored in the additional area in correspondence to the respective messages. In this manner, the message and the additional areas are used in memorizing the messages and the administration data as a content of the memory.

The memory is typically a random access memory (RAM). Therefore, the content of the memory is erased when the memory is deactivated by disconnection of the main electric power. The disconnection of the main electric power occurs when the power source switch is put into an off state. The disconnection also occurs when the main battery is detached from the pager receiver in order to exchange the main battery.

With a view to preventing such erasure of the content of the memory, a memory backup method is generally used wherein the memory is backed up by backup electric power supplied from a backup battery even when the memory is deactivated by disconnection of the main electric power.

In the manner known in the art, the content of the memory is not always correctly kept or retained in the memory when the memory is again activated after once deactivated. Therefore, a backup test is generally carried out when the memory is again activated after once deactivated. The backup test is for judging whether or not the content of the memory is correctly kept when the memory is again activated after once deactivated. This makes it possible to confirm the content of the memory by making the display unit display the content of the memory when the memory and the message processor are activated after once deactivated.

A conventional radio pager receiver capable of executing the backup test is disclosed in U.S. Pat. No. 4,779,091, by Takashi Ohyagi and Toshihiro Mori for assignment to the instant assignee. The Ohyagi et al patent application corresponds to European Patent Application No. 87101273.8 filed Jan. 30, 1987, Canadian Patent Application No. 528,529 filed Jan. 30, 1987, Australian Patent Application No. 68168/1987 filed Jan. 30, 1987, and Korean Patent Application No. 780/1987 filed Jan. 31, 1987.

In the conventional radio pager receiver, a specific datum is preliminarily written in a prescribed part of the additional area of the memory. The specific datum is, for example, a datum of two bytes consisting of "10101010" and "01010101" wherein each digit of one of the two bytes has one of logic "1" and "0" levels when a corresponding digit of another of the two bytes has the other of the logic "1" and "0" levels. In order to check whether or not the memory backup is correctly executed, the message processor judges whether or not the specific datum of two bytes is correctly kept in the prescribed part of the additional area of the memory when the memory is again activated after once deactivated.

Inasmuch as the specific datum of two bytes must be preliminarily written in the prescribed part of the additional area of the memory, it is defective in that the conventional radio pager receiver is incapable of readily checking whether or not memory backup is correct.

As an alternative of the specific datum of two bytes, it is possible to use another specific datum of one byte. In this event, a one-byte datum "00000000" would result when the specific datum of one byte is added to all data stored in the message area and the additional area collectively as stored data. It is therefore necessary to renew the specific datum of one byte so as to always provide the one-byte datum "00000000" whenever the stored data are renewed in the message and the additional areas. Such renewing operation of the specific datum of one byte is not only complicated but also time consuming. This is because it is necessary to check all stored data in the message and the additional areas whenever the stored data are renewed in the message and the additional areas.

At any rate, the conventional radio pager receiver is incapable of readily checking whether or not the memory backup is correct.

SUMMARY OF THE INVENTION

It is therefore an object of this invention to provide a radio pager receiver which is capable of readily checking whether or not memory backup is correct.

It is another object of this invention to provide a radio pager receiver of the type described, which is capable of saving time in checking whether or not the memory backup is correctly executed.

Other objects of this invention will become clear as the description proceeds.

A radio pager receiver to which this invention is applicable, is for receiving message signals carrying messages and destined to the pager receiver. The pager receiver comprises a memory activated by main electric power, backed up by backup electric power, and having a message area and an additional area, and a message processor including processing means activated by the main electric power for processing the message signals into the respective messages and administration data for use in administrating the messages and storing means activated by the main electric power for storing the messages in the message area and the administration data in the additional area in correspondence to the respective messages. According to this invention, the message processor is characterized by judging means coupled to the additional area and activated by the main electric power for judging whether or not the administration data are correctly kept in the additional area when the memory, the processing means, and the storing means are activated after once deactivated. The judging means thereby produces a result signal representative of a result of judgement.

DESCRIPTION OF THE PREFERRED EMBODIMENT

Figure 1:
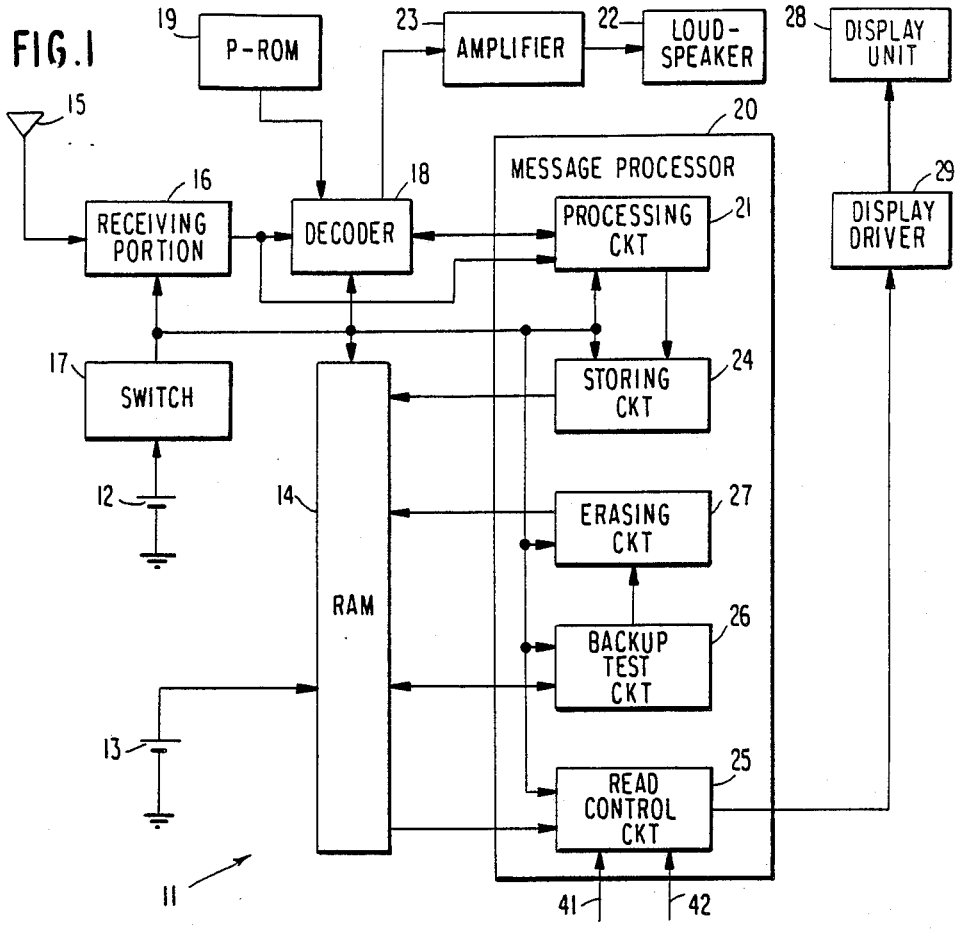
FIG. 1 is a block diagram of a radio pager receiver according to an embodiment of this invention.

Referring to FIG. 1, a radio pager receiver 11 according to a preferred embodiment of this invention is operable in response to a radio call signal which is transmitted from a transmitting station (not shown).

Figure 2:
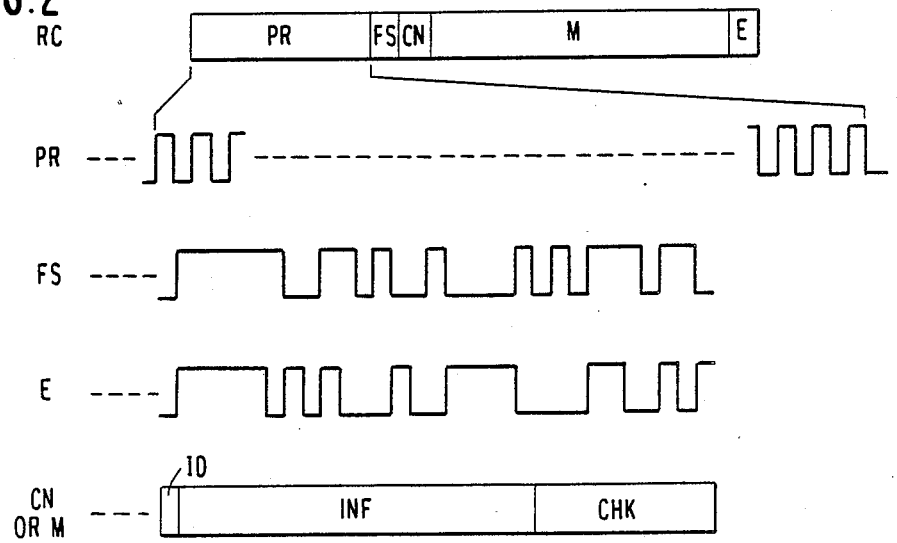
FIG. 2 is a time chart for use in describing a radio call signal received by the pager receiver illustrated in FIG. 1.

In FIG. 2, the radio call signal is indicated at RC along a top line. The radio call signal RC comprises a preamble signal PR of a first predetermined number of bits, a frame synchronization signal FS of a second predetermined number of bits, a call number signal CN of a third predetermined number of bits, a message signal M, and an end signal E of a fourth predetermined number of bits. The preamble signal PR, the frame synchronization signal FS, the call number signal CN, the message signal M, and the end signal E are successively arranged to form a frame. In the manner shown along a second line labelled PR, the preamble signal PR is specified by a repetition of pulses which are of logic "1" and "0" levels and are equal in number to the first predetermined number. The frame synchronization signal FS has a fixed pattern of the second predetermined number of bits as shown along a third line labelled FS. The end signal E has another fixed pattern of the fourth predetermined number of bits as illustrated along a fourth line labelled E. The fixed pattern of the end signal E is different from the fixed pattern of the frame synchronization signal FS. Each of the frame synchronization, the end, and the call number signals FS, E, and CN is formed by a BCH (Bose-Chaudhari-Hocquenghem) code which is well known in the art.

As depicted in a bottom line labelled "CN or M," the call number signal CN comprises an identification area ID positioned at the most significant bit (MSB) thereof, an information area INF, and a check bit area CHK. The call number signal CN is specified by a logic "0" level at the identification area ID and carries, in the information area INF, a call number which is assigned to each radio pager receiver. The message signal M is similar to the call number signal CN, as shown along the bottom line. The message signal M consists of the BCH code and is specified by a logic "1" level at the identification area ID. A message is located in the information area INF of the message signal M. The message has a variable message length which is not longer than a preselected maximum length in the manner which will later be described.

Turning back to FIG. 1, the radio pager receiver 11 is for use in combination with a main battery 12 for generating main electric power and a backup battery 13 for generating backup electric power. The pager receiver 11 comprises an RAM (random access memory) 14 coupled to the main battery 12 through a manually operable power source switch 17 and to the battery 13. The RAM 14 is activated by the main electric power when the switch 17 is closed to an on state. The RAM 14 is backed up by backup electric power when the switch 17 is opened.

The radio call signal is picked up by an antenna 15 and supplied to a receiving portion 16. The receiving portion 16 is coupled to the main battery 12 through the switch 17 and is activated by the main electric power when the switch 17 is put into the on state. The receiving portion 16, when activated, converts or demodulates the radio call signal into a baseband signal carrying the preamble signal PR, the frame synchronization signal FS, the call number signal CN, the message signal M, and the end signal E. The baseband signal is supplied to a decoder 18 as a succession of digital signals.

The decoder 18 is coupled to the main battery 12 through the switch 17. Therefore, the decoder 18 is activated by the main electric power when the switch 17 is put in the on state. When activated, the decoder 18 decodes the baseband signal into the preamble signal PR, the frame synchronization signal FS, the call number signal CN, the message signal M, and the end signal E.

More specifically, the decoder 18 establishes bit synchronization with reference to the preamble signal PR consisting of the repetition of logic "1" and "0" pulses. Thereafter, the decoder 18 detects the frame synchronization signal FS in order to establish frame synchronization.

The decoder 18 cooperates with a P-ROM (programmable read-only memory) 19 so as to detect the call number signal CN assigned to the pager receiver 11 under consideration. More specifically, the P-ROM 19 memorizes a directory number signal of a prescribed number of bits indicative of a directory number assigned to the pager receiver 11.

When the frame synchronization is established by detecting the frame synchronization signal FS, the decoder 18 starts to read the directory number signal from the P-ROM 19 and compares the call number signal CN with the directory number signal bit by bit to produce a coincidence pulse on detection of coincidence between bits of the call number and the directory number signals. The coincidence pulse is sent to a message processor 20 for processing the message signal in the manner which will presently be described.

The decoder 18 comprises a tone signal generator (not shown) responsive to a drive signal for generating a tone signal indicative of a call for the pager receiver in the manner which will presently be described.

The message processor 20 comprises a processing circuit 21 coupled to the main battery 12 through the switch 17. The processing circuit 21 is therefore activated by the main electric power when the switch 17 is put in the on state. The processing circuit 21 is for processing the message signals into the respective messages and administration data for use in collectively administrating the messages. The administration data will later be described. More specifically, the processing circuit 21 processes the message signal into the message and the administration datum in response to the coincidence pulse. In this event, the processing circuit 21 processes the message signals to have the administration data related to one another in accordance with a logical relationship which will become clear as the description proceeds.

When processing operation becomes to an end for each of the message signals, the processing circuit 21 produces a drive signal. In other words, the drive signal is produced when the processing circuit 21 detects the end signal E (FIG. 2). Responsive to the drive signal, the tone signal generator of the decoder 18 sends the tone signal to a loudspeaker 22 through an amplifier 23 to make the loudspeaker 22 generate a call tone indicative of arrival of a call to the pager receiver.

In the manner which will later be illustrated, the RAM 14 has a message area and an additional area, namely, an administration data area. A storing circuit 24 is activated by the main electric power like the processing circuit 21. The storing circuit 24 stores the messages in the message area and the administration data in the additional area in correspondence to the respective messages in the manner which will later be described more in detail. At any rate, the message and the additional areas are used in memorizing the messages and the administration data as a content of the RAM 14.

A read control circuit 25 and a backup test circuit 26 are activated by the main electric power like the processing circuit 21. The read control circuit 25 will later be described. In the manner which will also later be described more in detail, the backup test circuit 26 serves as a judging circuit for judging whether or not the administration data are correctly kept or retained in the additional area when the RAM 14, the processing circuit 21, and the storing circuit 24 are activated after once deactivated as a result of manipulation of the switch 17. More specifically, the backup test circuit 26 judges whether or not the logical relationship is correctly kept in the additional area. The backup test circuit 26 thereby produces a result signal representative of a result of judgement.

An erasing circuit 27 is activated by the main electric power and is coupled to the backup test circuit 26 and to the RAM 14. When the result signal representative of the result of judgement indicates that the administration data are not correctly kept or retained in the additional area, the erasing circuit 27 erases the content of the memory 14. For this purpose, the erasing circuit 27 supplies an earth or ground voltage to the RAM 14 during a predetermined time duration enough to erase the content of the memory 14. The content of the RAM 14 is erased by supplying the earth voltage to the RAM 14 even while the RAM 14 is put in the activated state by the main electric power.

Thus, the erasing circuit 27 is coupled to the backup test circuit 26 and to the message and the additional areas of the RAM 14 for erasing the messages and the administration data from the message area and the additional area in response to the result signal when the result of judgement indicates that the administration data are not correctly kept or retained in the additional area.

The message processor 20 may be of a single semiconductor chip. In this event, the processing, the storing, the read control, and the backup test, and erasing circuits 21, 24, 25, 26, and 27 may be made controlled by software.

A display unit 28 is, for example, a liquid crystal display (LCD). The display unit 28 is connected to the read control circuit 25 through a display driver 29 in visually displaying the messages and the like.

Figure 3:
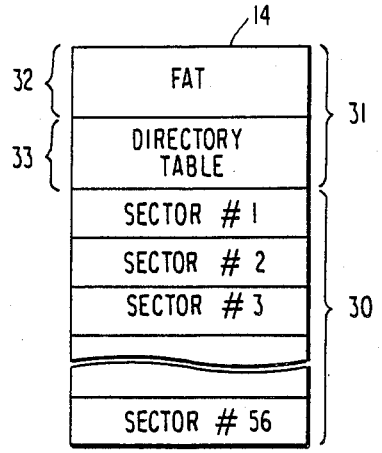
FIG. 3 is a diagram for use in describing operation of an RAM which is preferably used in the pager receiver illustrated in FIG. 1.

Referring to FIG. 3, description will be made as regards a structure of the RAM 14. It will be presumed that the RAM 14 is capable of memorizing a maximum of forty messages and that the RAM 14 is capable of memorizing messages having a total length equal to $(32\times56)$ bytes.

The RAM 14 has a message area 30 and a list area 31 which serves as the additional area, namely, the administrative data area and which is used in memorizing a list of the administration data. The message area 30 has first through fifty-sixth sectors which are numbered in FIG. 3 #1 through #56. Each of the sectors has a memory capacity of thirty-two bytes.

As described above, each of the messages has a variable message length which is not longer than a preselected maximum length of $(16\times32)$ bytes. A predetermined length of thirty-two bytes will be taken into consideration. The messages may include a message which is longer than the predetermined length and will be called a particular or long message. By the processing circuit 21 (FIG. 1), the long message is processed into a succession of message blocks which have the predetermined length in common. The message blocks are stored in different sectors by the storing circuit 24. The longest one of the messages consists of sixteen message blocks.

The list area 31 has a first partial area 32 for memorizing a file allocation table labelled FAT as a portion of the administration data and a second partial area 33 for memorizing a directory table as a remaining portion of the administration data. The file allocation table has first through fifty-sixth divisions (later be illustrated) in one-to-one correspondence to the first through the fifty-sixth sectors of the message area 30. The directory table has first through fortieth parts (later be illustrated) for memorizing directories in correspondence to the respective messages memorized in the message area 30.

Figure 4:
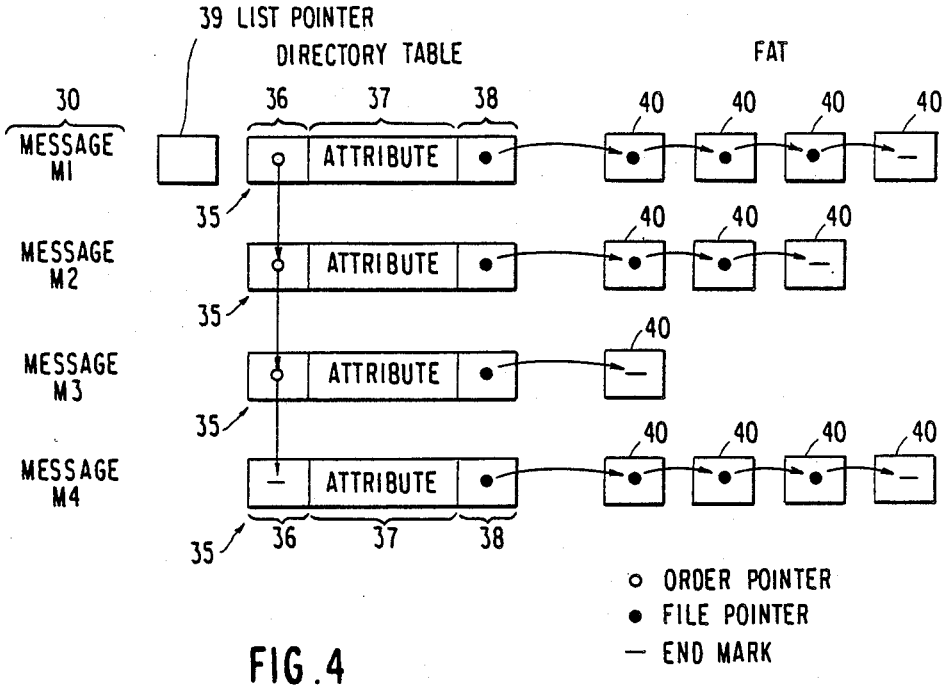
FIG. 4 is another diagram for use in describing operation of the RAM mentioned in connection with FIG. 3.

Turning to FIG. 4, first through fourth messages M1, M2, M3, and M4 are memorized in the message area 30. In correspondence, first through fourth parts 35 are illustrated among first through fortieth parts of the directory table and are memorized in the second partial area 33. The fifth through the fortieth parts of the directory table are similar to the illustrated parts 35. Each of the directories consists of an order pointer 36, an attribute 37, and a file pointer 38. The attribute 37 and the file pointer 38 will become clear as the description proceeds. In the manner which will later be described more in detail, the order pointers 36 are used in memorizing message linkage information. For each of the messages memorized in the message area 30, the message linkage information is indicative of a message order in which the message signals are processed by the processing circuit 21 into the respective messages.

With the file allocation table FAT of the first partial area 32, twelve divisions 40 are illustrated in FIG. 4 among the first through the fifty-sixth divisions which are in one-to-one correspondence to the first through the fifty-sixth sectors #1 to #56 (FIG. 3).

It will be supposed that the processing circuit 21 (FIG. 1) consecutively processes the message signals M (FIG. 2) into the first through the fourth messages M1 to M4 and that the storing circuit 24 (FIG. 1) consecutively stores the first through the fourth messages M1 to M4 in the message area 30 of the RAM 14. More particularly, the message signal M carrying the first message M1 is processed at first into the first message M1. Therefore, the first message M1 is memorized at first in the message area 30. Thereafter, the second message M2 is produced and memorized in the message area 30. In this manner, the fourth message M4 is memorized at last in the message area 30 after the third message M3 is memorized in the message area 30.

In the directory table exemplified in FIG. 4, a first directory is memorized in the first part 35 in the manner depicted along a top line. The first directory is for the first message M1 memorized in the message area 30. The first directory has the order pointer 36 indicating an address of the second part 35 depicted along a second line. In the second part 35, a second directory is memorized for the second message M2. The order pointer 36 of the second directory indicates an address of the third part 35 depicted along a third line. In the third part 35, a third directory is memorized for the third message M3. The third directory has the order pointer 36 indicating an address of the fourth part 35 depicted along a bottom line. A fourth directory is memorized for the fourth message M4 in the fourth part 35. The fourth directory has the order pointer 36 which memorizes a message end mark representing the fact that the fourth message M4 is last received by the pager receiver. That is, the message end mark represents absence of a following message which may otherwise follow the fourth message M4. The directory table further comprises a list pointer 39 indicating an address of the first part 35 as a start address of a list of the administration data.

Thus, the order pointers 36 and the list pointer 39 are used in memorizing message linkage information indicative for each of the messages of the message order in which the message signals are processed into the respective messages. In this connection, the message linkage information defines the logical relationship.

It will now be assumed that the first message M1 is a long message mentioned before and that the first message M1 is processed into first, second, third, and fourth message blocks. It will also be assumed that the first through the fourth message blocks are successively memorized in first through fourth sectors #1 to #4 (FIG. 3).

Memorized in the first part 35 depicted in the top line, the first directory has the file pointer 38 indicating an address of the first division 40 of the file allocation table FAT. The first division 40 corresponds to the first sector #1 and is indicated or specified by an arrow extended from the file pointer 38 of the first directory.

The first division 40 has a file pointer indicating an address of the second division 40 which corresponds to the second sector #2. The second division 40 is indicated by an arrow extended from the file pointer of the first division 40.

The second division 40 has a file pointer indicating an address of the third division 40 corresponding to the third sector #3. The third division 40 is specified by an arrow extended from the file pointer of the second division 40.

The third division 40 has a file pointer indicating an address of the fourth division 40 corresponding to the fourth sector #4. The fourth division 40 is indicated by an arrow extended from the file pointer of the third division 40.

The fourth division 40 memorizes a message block end mark representing that the fourth message block memorized in the fourth sector #4 is last received by the pager receiver among the first through the fourth message blocks of the first message M1.

It will readily be understood from a combination of the part 38 and the divisions 40 for the second message M2 that the second message M2 is processed into three message blocks. The third message M3 is not the longer message described above. The fourth message M4 is processed into four message blocks.

Thus, the parts 38 of the directory table and the divisions 40 of the file allocation table FAT are used in memorizing block linkage information indicative for each of the message blocks of a block order in which the longer message is processed into the message blocks. In other words, the block linkage information defines the logical relationship.

When the pager receiver newly receives a message signal carrying a fifth message after reception of the fourth message M4, the processing circuit 21 (FIG. 1) processes the message signal into the fifth message. In this event, the processing circuit 21 produces the fifth message in a form of a succession of message blocks in the manner described above. The storing circuit 24 (FIG. 1) stores the message blocks in the respective empty sectors each of which memorizes no message block. The storing circuit 24 furthermore stores a fifth directory for the fifth message in an empty part which memorizes no directory. The empty part is one of the fifth through fortieth parts of the directory table.

The fifth directory has an order pointer which memorizes a message end mark described before. The fifth directory also has a file pointer indicating an address of the division which corresponds to a leading one of the sectors memorizing the message blocks for the fifth message. Block linkage information for the fifth message is memorized in divisions of the file allocatioin table FAT like the block linkage information for each of the first through the fourth messages M1 to M4.

It should be noted here that the order pointer of the fourth directory for the fourth message M4 is renewed so as to indicate an address of the part memorizing the fifth directory instead of the message end mark.

It will be assumed that the pager receiver receives a message signal carrying a forty-first message after reception of a fortieth message.

The processing circuit 21 processes the forty-first message into at least one message block. When the forty-first message is not longer than the first message M1, the message processor 20 (FIG. 1) erases the first message memorized in the first through the fourth sectors #1 to #4 (FIG. 3) to make the first through the fourth sectors #1 to #4 empty. As a result, the first through the fourth sectors #1 to #4 become empty sectors. The message processor 20 also erases the first directory and the block linkage information for the first message M1.

Thereafter, the storing circuit 24 (FIG. 1) stores at least one message block of the forty-first message in at least one of the empty sectors. For the forty-first message, a forty-first directory is memorized in the first part 35 of the directory table instead of the first directory for the first message M1. Block linkage information for the forty-first directory is memorized in at least one division of the file allocation table FAT.

Inasmuch as the first directory is erased, the list pointer 39 is renewed so as to indicate an address of the second part 35 which memorizes the second directory for the second message M2. As a result, a start address of a list of the administration data becomes the address of the second part 35.

When the forty-first message is longer than the first message M1 and is not longer than a total length of the first and the second messages M1 and M2, the message processor 20 may erase the first and the second messages M1 and M2 memorized in the message area 30 so as to store the forty-first message in the message area 30. In this case, the message processor 20 should erase the first and the second directories and the block linkage information for the first and the second messages M1 and M2 in order to renew the directory table and the file allocation table.

In this manner, the directory table and the file allocation table FAT are renewed when the forty-first message is received by the pager receiver.

It should be noted here that the attribute 37 of each of the directories indicates whether the list is closed or open in the directory in question. More specifically, the attribute 37 of the directory in question indicates whether or not renewing operation of the list becomes an end in the directory in question.

Referring to FIGS. 1, 3, and 4, description will proceed to operation of the read control circuit 25. The pager receiver 11 comprises first and second keys (not shown) for producing first and second instruction signals 41 and 42 when the first and the second keys are operated by a possessor of the pager receiver 11, respectively. Responsive to the first instruction signal, the read control circuit 25 successively reads leading message blocks of the messages memorized in the message area 30 of the RAM 14. The leading message blocks of the messages are successively sent to the display driver 29. The display driver 29 makes the display unit 28 successively display the leading message blocks of the messages. Responsive also to the second instruction signal, the read control circuit 25 successively reads message blocks of one of the messages memorized in the message area 30 to make the display unit 28 successively display the message blocks of the message in question.

Figure 5A:
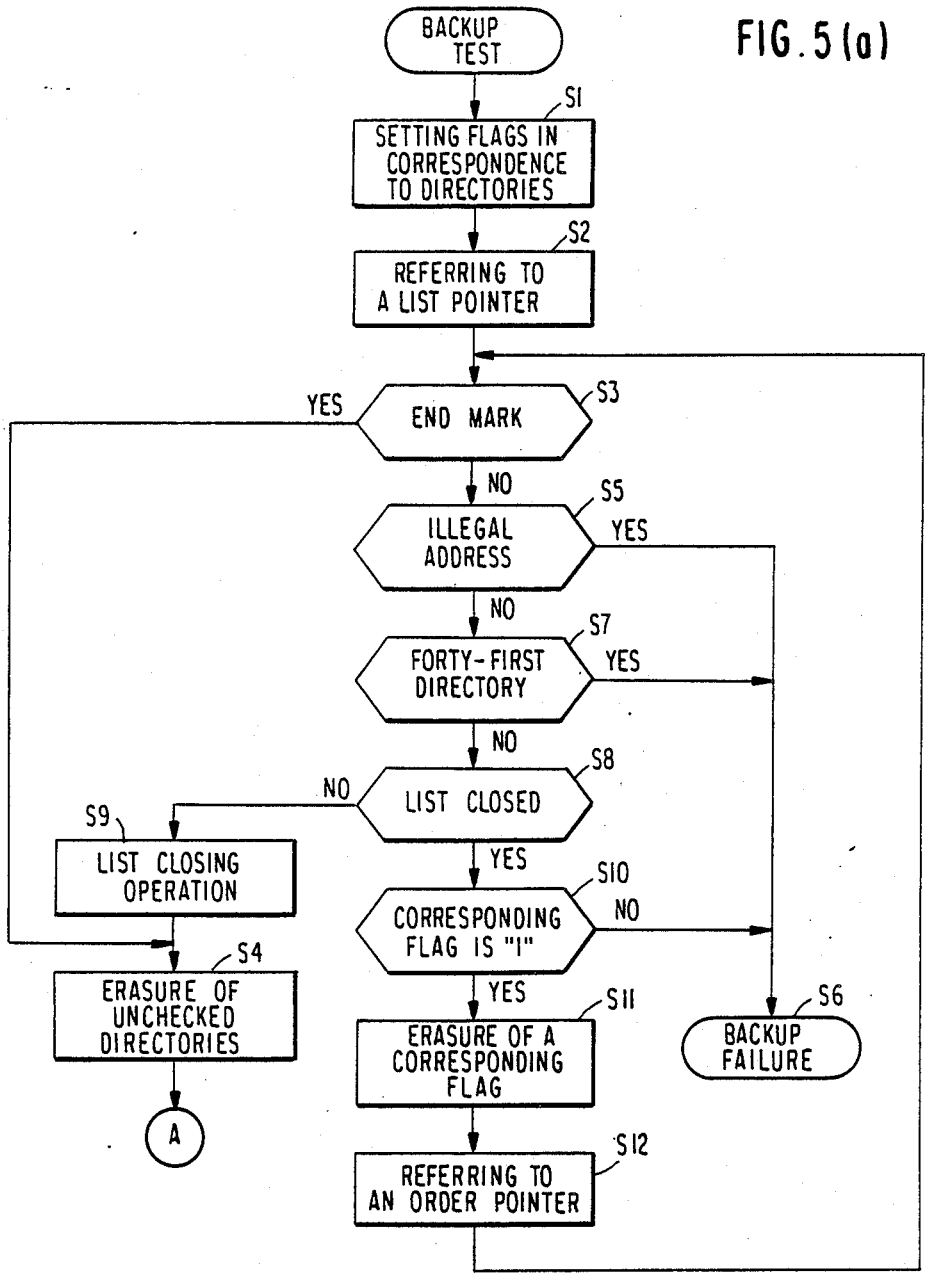
FIGS. 5(*a*) and 5(*b*) collectively show a flow chart for use in describing a backup test of the pager receiver illustrated in FIG. 1.
Figure 5:
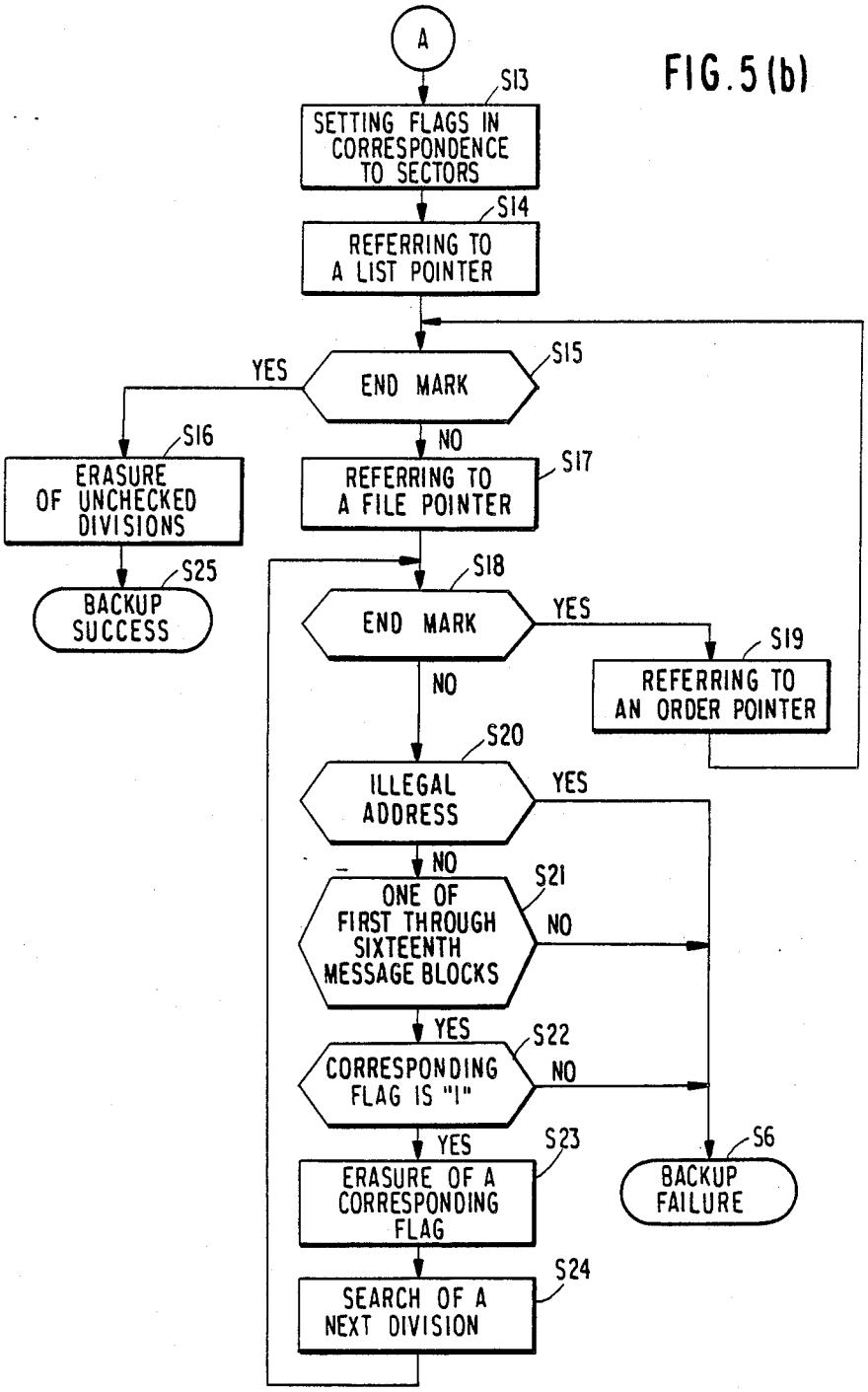

Turning to FIG. 5, description will proceed to backup test operation of the backup test circuit 26 (FIG. 1).

The backup test circuit 26 comprises a first working area (not shown) for memorizing flags in one-to-one correspondence to the respective parts 35 (FIG. 4) of the directory table of the RAM 14 (FIG. 1). Inasmuch as the number of the parts 35 is forty, the number of the flags is forty. Each of the flags is one bit and has a logic "1" level.

On starting the backup test operation, the backup test circuit 26 stores the flags in the first working area at a first stage S1. The first stage S1 is followed by a second stage S2.

At the second stage S2, the backup test circuit 26 refers to a content of the list pointer 39 (FIG. 4). The second stage S2 is followed by a third stage S3. At the third stage S3, judgement is carried out whether or not the content of the list pointer 39 is an end mark. When a result of the judgement is affirmative, operation proceeds to a fourth stage S4 which will later be described. In this case, no message is memorized in the message area 30 (FIG. 4). When the result of the judgement is negative, operation proceeds to a fifth stage S5. In this case, the content of the list pointer 39 indicates an address of a directory for a leading message as described above. At the fifth stage S5, judgement is carried out whether or not the address of the directory for the leading message is an illegal address. The illegal address specifies an undefined address other than addresses which are present within the directory table. When a result of the judgement is affirmative, the fifth stage S5 is followed by a sixth stage S6. Otherwise, the fifth stage is followed by a seventh stage S7.

At the sixth stage S6, the backup test circuit 26 makes the erasing circuit 27 erase the content of the RAM 14 (FIG. 1) because the memory backup operation ends in failure.

At the seventh stage S7, judgement is made whether or not the address of the directory for the leading message erroneously indicates a forty-first directory which is undefined. When a result of the judgement is affirmative, operation proceeds to the sixth stage S6. Otherwise, operation proceeds to an eighth stage S8.

At the eighth stage S8, judgement is made whether or not the list is closed with reference to the attribute 37 (FIG. 4) of the directory in question. When a result of the judgement is negative, operation proceeds to a ninth stage S9 which will later be described. Otherwise, operation proceeds to a tenth stage S10.

At the tenth stage S10, judgement is carried out whether or not the flag corresponding to the directory in question is still a logic "1" level. When the flag is not a logic "1" level, the memory backup operation is a failure. Operation therefore proceeds to the sixth stage S6. Otherwise, operation proceeds to an eleventh stage S11 at which the flag is erased from the first working area. As a result, check operation becomes to an end for the directory of the leading message. The eleventh stage S11 is followed by a twelfth stage S12.

At the twelfth stage S12, the backup test circuit 26 refers to an order pointer of the directory for the leading message. The twelfth stage S12 is followed by the third stage S3.

Check operation is made for a next directory having an address which is indicated by the order pointer of the directory for the leading message. Such check operation is made in the manner similar to the check operation for the directory of the leading message at the third, the fifth, the seventh, the eighth, and the tenth stages S3, S5, S7, S8, and S10.

When the next directory has an order pointer 36 which memorizes an end mark (that is, a message end mark), the third stage S3 is followed by the fourth stage S4.

At the fourth stage S4, the backup test circuit 26 carries out erasure operation of unchecked directories. The fourth stage S4 is followed by a thirteenth stage S13 which will later be described.

When the next directory has an attribute 37 indicating that the list is open, the eighth stage S8 is followed by the ninth stage S9.

At the ninth stage S9, the backup circuit 26 stores a message end mark in the order pointer of the directory for the leading message. In other words, the message end mark is stored in the order pointer of a previous directory which is stored immediately before the next directory. In this manner, the list is closed. The ninth stage S9 is followed by the fourth stage S4.

A last directory corresponding to a last message has an order pointer having a message end mark. When check operation becomes to an end for the last directory, the message end mark is detected at the third stage S3. As a result, operation proceeds to the fourth stage S4 which is followed by the thirteenth stage S13.

Thus, the backup test circuit 26 judges whether or not the message linkage information is correctly kept or retained in the additional area 33. That is, the backup test circuit 26 judges whether or not a logical relationship of the message linkage information is correctly kept in the additional area 33.

Description will proceed to check operation of the block linkage information.

The backup test circuit 26 further comprises a second working area (not shown) for memorizing flags in one-to-one correspondence to the respective divisions 40 (FIG. 4) of the file allocation table FAT (FIG. 4) of the RAM 14. The divisions 40 are in one-to-one correspondence to the sectors #1 to #56 of the message area 30 as described above. Inasmuch as the number of the divisions 40 is fifty-six, the number of the flags is fifty-six. Each of the flag is one bit and has a logic "1" level.

At the thirteenth stage S13, the backup test circuit 26 stores the flags in the second working area. The thirteenth stage S13 is followed by a fourteenth stage S14.

At the fourteenth stage S14, the backup test circuit 26 again refers to a content of the list pointer 39. The fourteenth stage S14 is followed by a fifteenth stage S15.

At the fifteenth stage S15, judgement is carried out whether or not the content of the list pointer is an end mark. When a result of the judgement is affirmative, operation proceeds to a sixteenth stage S16 which will later be described. When the result of the judgement is negative, operation proceeds to a seventeenth stage S17. In this case, the content of the list pointer 39 indicates an address of a directory for a leading message as described above.

At the seventeenth stage S17, the backup test circuit 26 refers to a file pointer 38 (FIG. 4) of the directory for the leading message. The file pointer 38 of the directory for the leading message indicates an address of a division 40 corresponding to a sector which memorizes a first message block of the leading message. The seventeenth stage S17 is followed by an eighteenth stage S18.

At the eighteenth stage S18, judgement is carried out whether or not a content of the file pointer 38 is a message block end mark. When a result of judgement is affirmative, operation proceeds to a nineteenth stage S19 which will later be described. When the result of the judgement is negative, operation proceeds to a twentieth stage S20.

At the twentieth stage S20, judgement is carried out whether or not the address indicated by the file pointer 38 of the directory for the leading message is an illegal address other than addresses which are within the file allocation table FAT. When a result of the judgement is affirmative, operation proceeds to the sixth stage S6 described above. When the result of the judgement is negative, operation proceeds to a twenty-first stage S21.

At the twenty-first stage S21, judgement is made whether or not a division 40 having the address indicated by the file pointer 38 of the directory for the leading message corresponds to a sector which is used in memorizing one of first through sixteenth message blocks for each message. A seventeenth message block does not have to appear in such judgement. This is because a message of seventeen message blocks is undefined in this pager receiver. When the result of the judgement is negative, operation proceeds to the sixth stage S6 described above. When the result of the judgement is affirmative, operation proceeds to a twenty-second stage S22.

At the twenty-second stage S22, judgement is carried out whether or not the flag corresponding to the directory in question is still a logic "1" level. When the flag is not a logic "1" level, operation proceeds to the sixth stage S6. Otherwise, operation proceeds to a twenty-third stage 23 at which the flag is erased from the second working area. As a result, check operation becomes to an end for the file pointer 38 of the directory for the leading message. The twenty-third stage S23 is followed by a twenty-fourth stage S24.

At the twenty-fourth stage S24, the backup test circuit 26 searches for a second division 40 located in the address which is indicated by the file pointer 38 of the directory for the leading message. The second division 40 has a file pointer indicating either a message block end mark or an address of a different division 40 corresponding to a sector which memorizes a second message block of the leading message.

When the message block end mark is detected at the eighteenth stage S18, operation proceeds to the nineteenth stage S19. Otherwise, operation proceeds to the twelfth stage S20 described above.

At the nineteenth stage S19, the backup test circuit 26 refers to an order pointer of the directory for the leading message.

Check operation of the block linkage information is made for a next directory having an address which is indicated by the order pointer of the directory for the leading message. Such check operation is made in the manner similar to the check operation of the block linkage information for the directory of the leading message at the fifteenth, the seventeenth, the eighteenth, the twentieth, the twenty-first, the twenty-second, the twenty-third, and the twenty-fourth stages S15, S17, S18, S20, S21, S22, S23, and S24.

When the next directory has an order pointer 36 which memorizes an end mark (that is, a message end mark), the fifteenth stage S15 is followed by the sixteenth stage S16.

At the sixteenth stage S16, the backup test circuit 26 carries out erasure operation of unchecked divisions. The sixteenth stage is followed by a twenty-fifth stage at which the backup test circuit 26 confirms that the memory backup is correctly carried out.

Thus, a last directory corresponding to a last message has an order pointer having a message end mark. When check operation of the block linkage information becomes to an end for the last directory, the message end mark is detected at the fifteenth stage S15. As a result, operation proceeds to the sixteenth stage S16 which is followed by the twenty-fifth stage S25.

As described above, the backup test circuit 26 judges whether or not the message linkage information is correctly kept or retained in the additional area 33. That is, the backup test circuit 26 judges whether or not a logical relationship of the block linkage information is correctly kept in the additional area 33.

Figure 6:
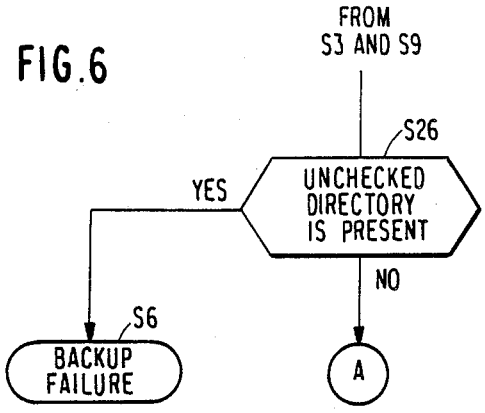
FIG. 6 is another flow chart for use in describing another backup test of the pager receiver illustrated in FIG. 1.
Figure 7:
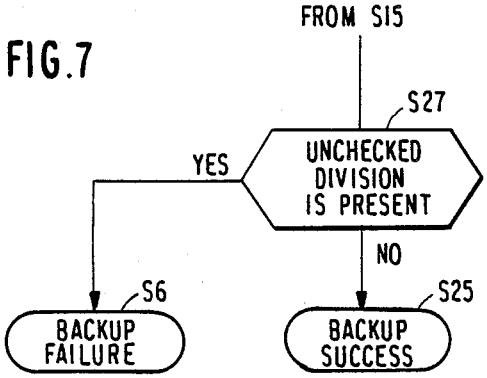
FIG. 7 is still another flow chart for use in describing a part of another backup test illustrated in FIG. 6.

Referring to FIGS. 6 and 7, description will proceed to another backup test operation of the backup test circuit 26 (FIG. 1).

Referring to FIG. 6, a twenty-sixth stage S26 is carried out instead of the fourth stage S4 illustrated in FIG. 5. When the result of the judgement at the third stage S3 is affirmative, the third stage S3 proceeds to the twenty-sixth stage S26. The twenty-sixth stage S26 also follows the ninth stage S9. At the twenty-sixth stage S26, judgement is made whether or not an unchecked directory is present. The unchecked directory is, for example, an independent directory having an administration datum which is not related at all to other administration data in accordance with a logical relationship. When the unchecked directory is present, operation proceeds to the sixth stage S6 at which the content of the RAM 14 is erased. Otherwise, the twenty-sixth stage S26 is followed by the thirteenth stage S13.

Referring to FIG. 7, a twenty-seventh stage S27 is carried out instead of the sixteenth stage S16 illustrated in FIG. 5. When the result of the judgement at the fifteenth stage S15 is affirmative, the fifteenth stage S15 proceeds to the twenty-seventh stage S27 at which an unchecked division 40 is present. The unchecked division 40 (FIG. 4) is, for example, an independent division having an administration datum which is not related at all to other administration data in accordance with a logical relationship. When the unchecked division is present, operation proceeds to the sixth stage at which the content of the RAM 14 is erased. Otherwise, the twenty-seventh stage S27 is followed by the twenty-fifth stage S25 described above.

What is claimed is:

1. In a radio pager receiver for receiving message signals carrying messages and destined to said pager receiver, said pager receiver comprising a memory activated by main electric power, backed up by backup electric power, and having a message area and an administration data area, and a message processor including processing means activated by said main electric power for processing said message signals into the respective messages and a plurality of administration data for use in administrating said messages and storing means activated by said main electric power for storing said messages in said message area and said plurality of administration data in said administration data area in correspondence to the respective messages, the improvement wherein:

said processing means is for processing said message signals so that a logical relationship is established between said plurality of administration data;

said message processor comprising, judging means coupled to said administration data area and activated by said main electric power for judging whether or not said logical relationship is correctly kept in said administration data area when said memory, said processing means, and said storing means are activated after once deactivated, said judging means thereby producing a result signal representative of a result of judgment.

2. A radio pager receiver as claimed in claim 1, wherein said processing means is for making said logical relationship comprise message linkage information indicative for each of said messages of a message order in which said message signals are processed into the respective messages, said storing means being for storing said message linkage information in said administration data area for said messages, said judging means being for judging whether or not said message linkage information is correctly kept in said administration data area for said messages when said memory, said processing means, and said storing means are activated after once deactivated.

3. A radio pager receiver as claimed in claim 2, said messages including a particular message which is longer than a predetermined length, wherein said processing means is for processing said particular message into a succession of message blocks having said predetermined length in common and for making said logical relationship comprise block linkage information indicative for each of said message blocks of a block order in which said particular message is processed into said message blocks, said storing means being for storing said block linkage information in said administration data area for said message blocks, said judging means being for judging whether or not said block linkage information is correctly kept in said administration data area for said message blocks when said memory, said processing means, and said storing means are activated after once deactivated.

4. A radio pager receiver as claimed in claim 1, wherein said message processor further comprises erasing means activated by said main electric power and coupled to said judging means and to said message and said administration data areas for erasing said messages and said plurality of administration data from said message area and said administration data area in response to said result signal when said result of judgment indicates that said logical relationship is not correctly kept in said administration data area.

5. A method of checking whether or not a memory backup of a pager receiver is correct, said pager receiver comprising a memory having a message area and an administration data area, said method comprising the steps of:

applying main electric power to said pager receiver;

receiving message signals carrying messages and destined to said pager receiver when said main electric power is applied to said pager receiver;

processing said message signals into the respective messages and plurality of administration data for use in administrating said messages when said main electric power is applied to said pager receiver, said processing step being for processing said message signals so that a logical relationship is established between said plurality of administration data;

storing said messages in said message area and said plurality of administration data in said administration data area in correspondence to the respective messages when said main electric power is applied to said pager receiver;

applying backup electric power to at least said memory when said main electric power is stopped; and judging whether or not said logical relationship is correctly kept in said administration data area when said main electric power is resumed after once stopped.

* * * * *

UNITED STATES PATENT AND TRADEMARK OFFICE

CERTIFICATE OF CORRECTION

PATENT NO. : 4,940,975

DATED : July 10, 1990

INVENTOR(S) : Motoki IDE and Toshifumi SATO

It is certified that error appears in the above-identified patent and that said Letters Patent is hereby corrected as shown below:

Col. 12, line 14, delete "23" and insert --S23--;

Col. 12, line 30, delete "twelfth" and insert --twentieth--

Signed and Sealed this

Third Day of December, 1991

*Attest:*

HARRY F. MANBECK, JR.

*Attesting Officer*

*Commissioner of Patents and Trademarks*